US006389666B1

(12) United States Patent
Grothe

(10) Patent No.: US 6,389,666 B1
(45) Date of Patent: May 21, 2002

(54) METHOD OF AND APPARATUS FOR DESCALING OF SURFACES HAVING OSCILLATION MARKS OF CAST BILLETS PRODUCED BY A CONTINUOUS CASTING MACHINE

(75) Inventor: Horst Grothe, Caarst (DE)

(73) Assignee: SMS Schloemann-Siegmag AG, Düsseldorf (DE)

( * ) Notice: Subject to any disclaimer, the term of this patent is extended or adjusted under 35 U.S.C. 154(b) by 0 days.

(21) Appl. No.: 09/479,610

(22) Filed: Jan. 7, 2000

(30) Foreign Application Priority Data

Jan. 8, 1999 (DE) ..... 199 00 427

(51) Int. Cl.[7] ..... B21B 45/04
(52) U.S. Cl. ..... 29/81.08; 29/81.03; 29/81.06
(58) Field of Search ..... 29/81.03, 81.06, 29/81.08, 81.01, 527.7, 81.09; 72/39, 40, 127

(56) References Cited

U.S. PATENT DOCUMENTS 3,209,429 A * 10/1965 Amtmann ..... 29/81.08
3,518,736 A * 7/1970 Domeika ..... 29/81.08
5,036,689 A * 8/1991 Sekiya et al. ..... 29/81.08
5,272,798 A * 12/1993 Cole et al. ..... 29/81.08
5,634,257 A * 6/1997 Kajiwara et al. ..... 29/527.7

FOREIGN PATENT DOCUMENTS

JP 61269925 A * 11/1986 ..... 72/39

* cited by examiner

*Primary Examiner*—S. Thomas Hughes
*Assistant Examiner*—Marc Jimenez
(74) *Attorney, Agent, or Firm*—Sidley Austin Brown & Wood, LLP

(57) ABSTRACT

A method of descaling surfaces having oscillation marks of cast billets produced by a continuous casting process an reduced in a hot strip train including an equalizing furnace and a plurality of rolling mill stands, with the cast billets being delivered from a continuous casting machine through a billet guide, with the method including subjecting surfaces of a cast billet, in a limited region between an end of the billet guide and an entrance of one of the equalizing furnace and a first rolling mill stand, by at lease a double deflection of the cast billet from a horizontal transporting path of the cast billet, to stretching in a region of each deflection, and subjecting the surfaces of the cast billet to an intensive flushing with hard water jets in the deflection regions of the eight-gage slab.

1 Claim, 2 Drawing Sheets

METHOD OF AND APPARATUS FOR DESCALING OF SURFACES HAVING OSCILLATION MARKS OF CAST BILLETS PRODUCED BY A CONTINUOUS CASTING MACHINE

BACKGROUND OF THE INVENTION

1. Field of the Invention

The present invention relates to a method of descaling surfaces having oscillation marks of cast billets, in particular of light-gage slabs, produced by a continuous casting process and reduced in a hot strip train including an equalizing furnace and, preferable, a plurality of rolling mill stands. The present invention also relates to an apparatus for effecting the method.

2. Description of the Prior Art

There exist certain difficulties in cleaning of surfaces of cast billets, in particular of light-gage slabs, produced by a continuous casting machine. These difficulties are primarily caused by the fact that the surfaces of the cast billets have irregularities, so-called, oscillation marks extending transverse to the displacement direction of the cast billets as they leave the continuous casting machine. These oscillation marks result from the oscillation of the metal mold.

These difficulties are enhanced by the fact that the oscillation marks do not remain constant during the casting operation. They vary during the casting operation and, in particular, their depth varies.

With time, in the course of improvement to the continuous casting technology, particular attention was devoted to the design and the function of the metal mold, and both, forming a centerpiece of a continuous strip casing technology, are constantly improved. Parallel therewith, an improved cast powder was tested and used as a lubricant, contributing to an increase of casting speeds.

The use of a high-frequency oscillation system in connection with an optimal geometry of the metal mold permitted to achieve a constant improvement of the surface quality of the cast products.

Despite this noticeable improvement of the surface quality, there still exists a need, in particular for light-gage slabs, to clean the cast products from impurities, such as dust particles, foreign particles clinging to the surfaces, etc. . . . by descaling in order to prevent their rolling in the surfaces of the cast products during the rolling of the cast product in rolling mill stands. In particular, these impurities should be removed from the bottoms of still existing oscillation marks which is particularly difficult when the oscillation marks have an angular or pointed cross-section.

Accordingly, an object of the present invention is a method and an apparatus which would permit to overcome the difficulties encountered during cleaning of the surfaces of continuously cast products, in particular light-gage slabs, and more particularly, which would permit to remove impurities containing in and around the oscillation marks.

Another object of the present invention is to provide a method of and an apparatus for descaling surfaces of the cast products which would prevent an undesired excessive cooling of the cast product by using as little amount of water under pressure as possible.

SUMMARY OF THE INVENTION

These and other objects of the present invention, which will become apparent hereinafter, are achieved, according to the present invention, by subjecting surfaces of a cast billet, in a limited region between an end of the billet guide and an entrance of the equalizing furnace or a first rolling mill stand, by at least a double deflection of the cast billet from a horizontal transporting path of the cast billet, to stretching in a region of each deflection, and by subjecting the surfaces of the cast billet to an intensive flushing with hard water jets in the deflection regions of the light-gage slab.

The contemplated, according to the present invention, deformation of the cast billet permits to provide tensile stress regions which insure a somewhat wider opening of the oscillation marks which, in turn, insure a better action of the hard water jets, providing for a more intensive cleaning effect penetrating up to the bottoms of the oscillation marks.

According to a preferred embodiment of the present invention, the cast billet is deflected sinusoidally or approximately sinusoidally.

The sinusoidal or approximately sinusoidal deflection insures an approximately uniform increase and decrease of the surface stress, preventing damage of the cast billet structure.

Accordingly, to a further development of the present invention, an amount of each deflection of the cast billet is determined in accordance with a maximum allowable deformation of the cast billet and/or a maximum allowable surface tension of the cast billet.

Accordingly, to a still further development of the present invention, an amount of each deflection is determined in accordance with a temperature of the cast billet under a condition of a permanent temperature control.

The maintenance of allowable deformation, maximum allowable surface tension or temperature insures a maximum bending of the cast billet, while preventing any damaging structural changes in the cast billet.

According to the present invention, the distance between the spray nozzles and the flushed surfaces is continuously measured and adjusted so that this distance remains substantially constant. This permits to maintain the operational parameters of the hard cleaning jets of water constant to a most possible extent.

To this end, it is contemplated to constantly measure the pressure of the spray water and to maintain the water pressure at a high level.

According to a further preferred embodiment of the present invention, it is contemplated to impinge respective surfaces with a plurality of water jets lying in parallel planes and arranged in a row, with the planes of the water jets extending at an angle to a respective plane extending transverse to a transporting direction of the cast billet, and with the water jets being inclined to respective surfaces of the cast billet.

The advantage of directing of water jets in the foregoing manner insures that the pressure water jets can more easily reach the bottoms of the oscillation marks. This is because a transverse or inclined infringement direction of the water jets with respect to the displacement direction of the cast billet proved to be more favorable for cleaning purposes than a parallel direction.

A further improvement of the cleaning action is achieved by reciprocating girders with water jet-producing nozzles in planes extending transverse to the transporting or displacement direction of the cast slab.

According to yet another embodiment of the present invention, a variable deflection force in accordance with a structural condition of the cast billet corresponding to cooling, which takes place simultaneously with the descaling, is measured, and the water consumption is constantly adjusted, with maintaining a product of the water amount and the water pressure constant. Thereby, it becomes possible to compensate changes in the billet parameters which occasionally can be caused by the operation of the continuous casting machine, e.g., as a result of a change of the casting speed or the casting temperature.

An apparatus for descaling surfaces having oscillation marks of cast billets produced by a continuous casting process and reduced in a hot strip train including an equalizing furnace and a plurality of rolling mill stands, with the cast billets being delivered from a continuous casting machine through a billet guide, includes a pair of straightening guide rollers provided at and end of the billet guide, a pair of bending drive rollers provided in front of an entrance of the equalizing furnace or an entrance of the rolling mill stands, and a descaling station arranged between the pairs of the straightening drive rollers and the bending drive rollers and including at least two oppositely arranged deflection bending rollers spaced from each other in a transporting direction, and a spray girder provided on each of opposite sides of the cast billet and having a plurality of spray nozzles arranged in an inclined plane.

The novel features of the present invention, which are considered as characteristic for the invention, are set forth in particular in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

Figure 1:
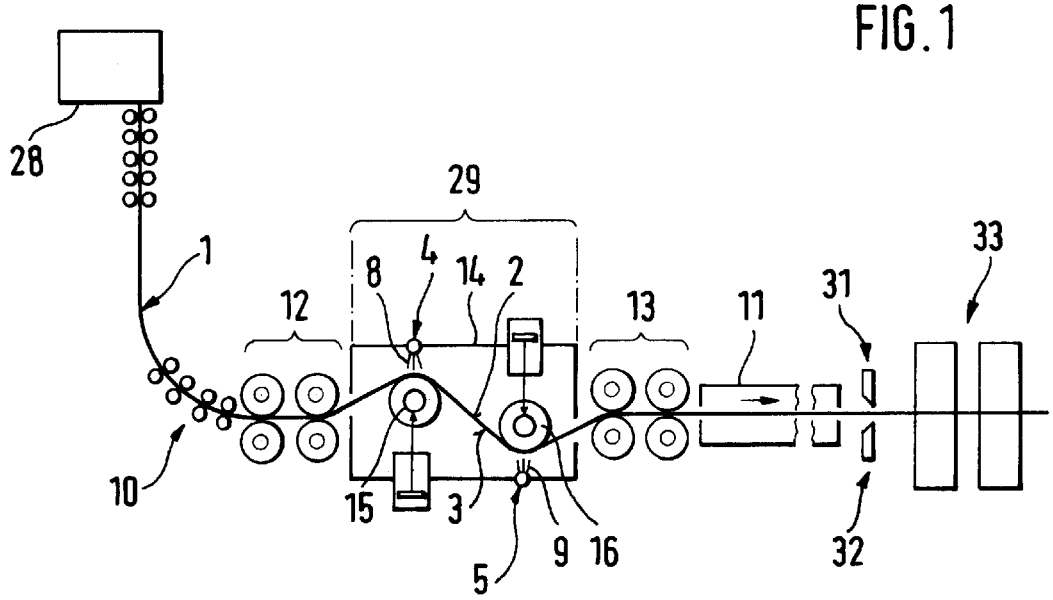
FIG. 1 a schematic view of a continuous casting plant with an associated apparatus for descaling surfaces having oscillations marks of light-gage slabs produced by a continuous casting process.
Figure 3A:
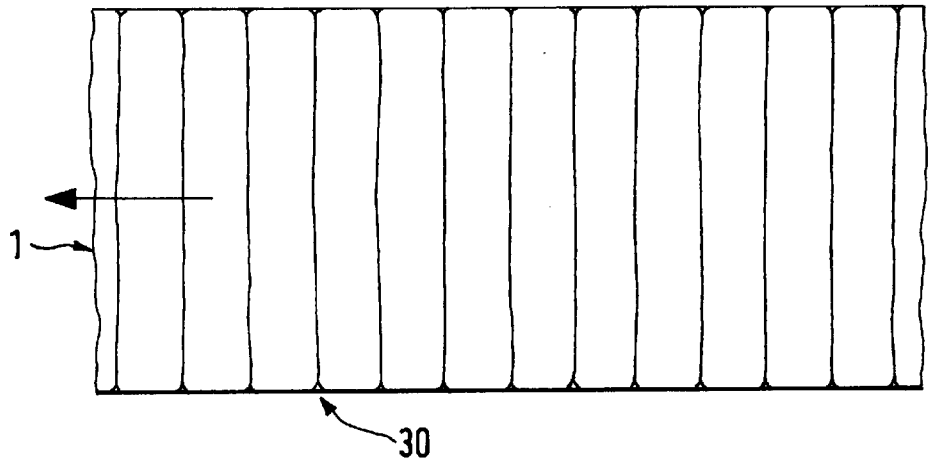
FIG. 3*a* a plan view of a light-gage slab surface with oscillation marks.
Figure 3B:
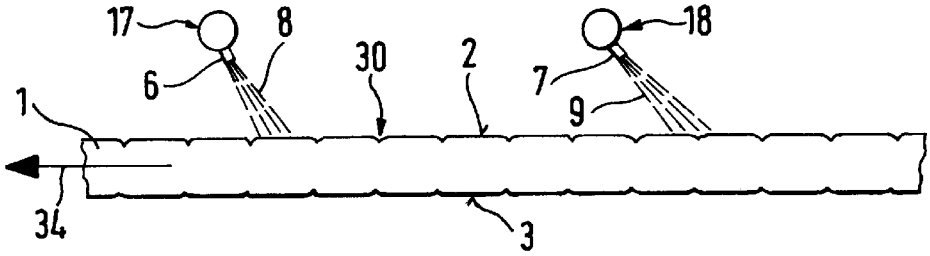
FIG. 3*b* side view of a slab section shown in FIG. 3*a*.

FIG. 1 shows a portion of a continuous casting plant including a continuous casting machine 28 and a billet guide 10 for supporting and guiding a cast billet 1, in particular, a light-gage slab, and which is arranged at the outlet of the continuous casting machine 28. The light-gage slab is reduced in a hot strip train including an equalizing furnace 11 and a plurability of rolling mill stands 33. Crop shears 31 are provided between the equalizing furnace 11 and the first rolling mill stand 33. At the end of the billet support 10, in the transitional region where the light-gage slab 1 passes into a horizontal transporting device, there are provided straightening drive rollers 12. The straightening drive rollers 12 are arranged in front of the descaling station or apparatus 14 and, together with bending drive rollers 13 provided at the outgoing side of the descaling station 14, guide the light-gage slab 1 through the descaling station 14. The descaling station 14 includes two, arranged opposite each other, deflection bending rollers 15 and 16. The deflection bending rollers 15 and 16 are spaced from each other in the transporting direction of the light-gage slab 1. A respective spray girder 17, 18 with a corresponding set of nozzles 7, 8 is associated with each of the rollers 15, 16 respectively. The nozzles 7 and 8, as shown in FIGS. 3*a* and 3*b*, are inclined to the plane of the slab. Spacing probes 19 and 20 and spacing control means 21 and 22 are associated with the spray girders 17 and 18, respectively. The spacing probes 19 and 20 and the spacing control means 21 and 22 insure a maintaining of constant spacings of the spray nozzles 7, 8 from opposite surfaces 2 and 3 of the light-gage slab 1, respectively.

Controlled adjusting cylinders 23, 23 and position sentors 25, 26 are associated with the deflection bending rollers 15, 16 respectively.

The adjusting cylinders 23, 24 provide for displacement-controlled or load-controlled changing of the spacing between the deflection bending rollers 15 and 16. Control means for monitoring the deflection 4, 5 or the deflection forces can be associated with adjusting cylinders 23, 24. The descaling station 14 is covered with a protection box 27 which protects it against an environmental influence.

Figure 2:
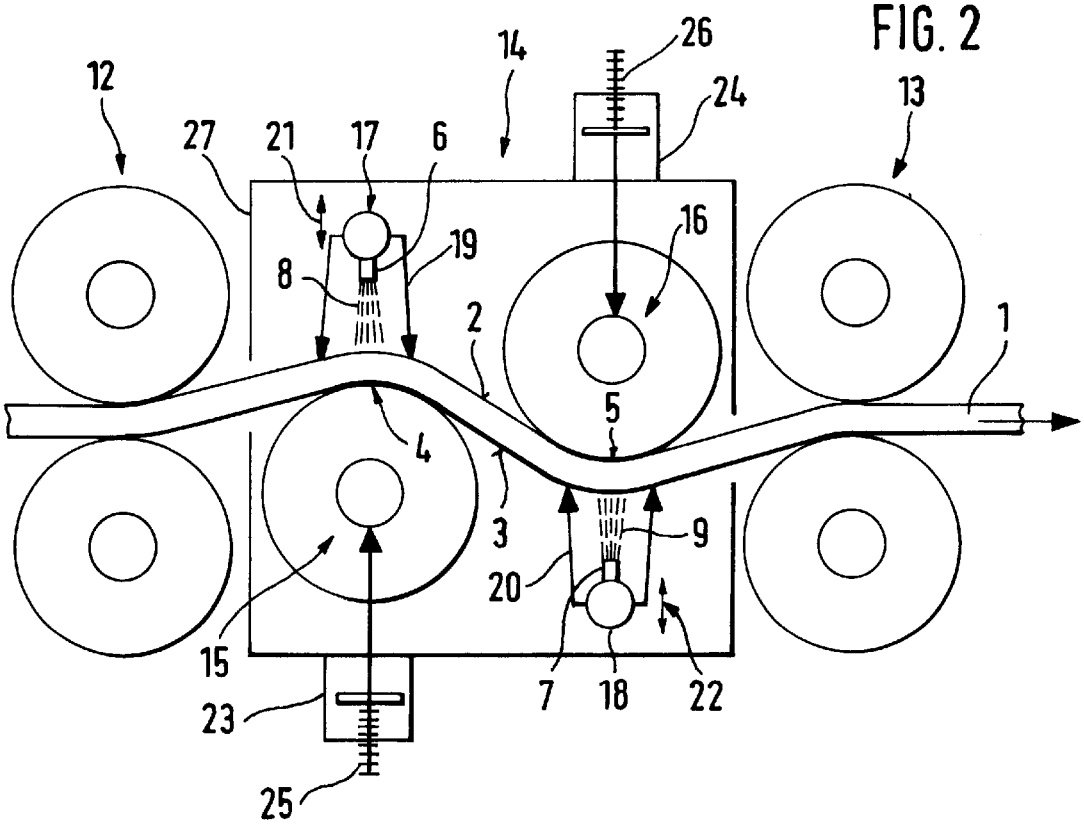
FIG. 2 a side view at an increased scale of a descaling apparatus shown in FIG. 1.

As shown in FIGS. 1 and 2, the light-gage slab 1 is subjected, in a limited region 29 between the end of the billet guide 10 and the entrance of the equalizing furnace 11, to at least double deflection from its horizontal transporting path. As a result of the deflections, the slab surfaces 2 and 3 are subjected, in the region of each deflection 4, 5 to stretching. In addition, the slab surfaces 2, 3 are subjected, in the deflection regions 4, 5 to an intensive flushing with hard water jets 8, 9.

The corresponding adjusting means 23–26 of the deflection bending rollers 15, 16 controls the amount of the deflections 4, 5 of the light-gage slab 1 in accordance with its maximum allowable deformation.

The amount of the deflections 4, 5 can also be controlled in accordance with a maximum allowable surface tension.

Figure 4:
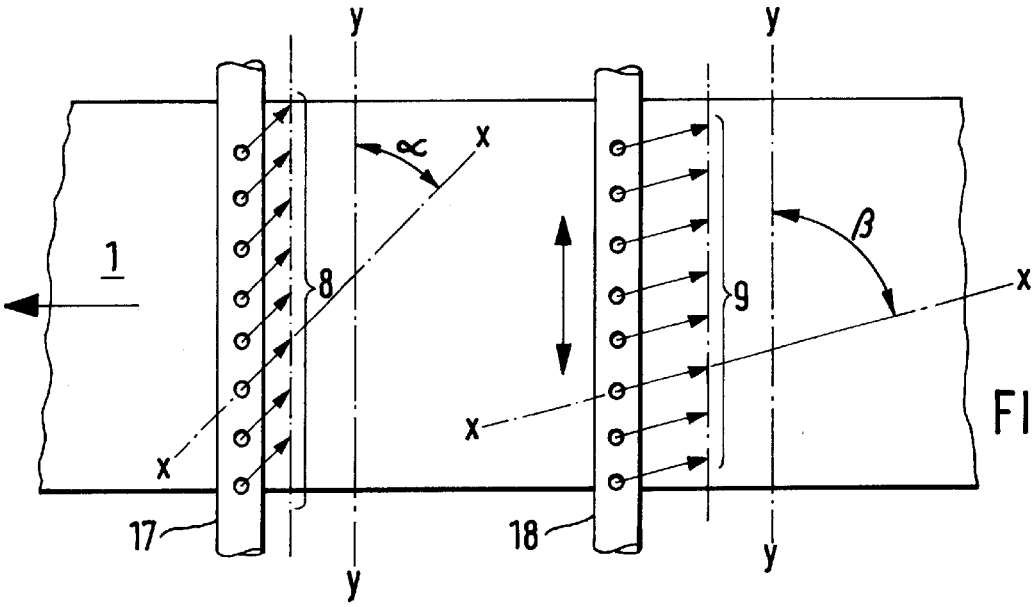
FIG. 4 a plan view of a light-gage slab section with a spray girder and spray nozzles arranged thereabove.

FIGS. 3*a*, 3*b*, and 4 show that the light-gage slab 1 is subjected to action of water jets 8, 9 arranged in a row in parallel planes x—x. The water jet planes X—X or X'—X' extend at an angle $\alpha$ or $\beta$ to a plane Y—Y extending perpendicular to the slab transporting direction, so that the water jets 8, 9 are inclined toward respective surfaces 2, 3 of the light-gage slab 1. The water jets 8, 9 completely wash out the oscillation marks 30.

In addition, the water jets 8, 9 produced by the spray girders 17, 18 can reciprocate in the plane Y—Y. The water jets 8, 9 can run at an angle toward the transporting direction of the light-gage slab 1, as sown in FIG. 3*a* or 3*b*. However, the water jets 8, 9 can be directed perpendicular to the transporting direction. The direction of the water jets 8, 9 can be predetermined for each case, defendant on the prevailing operational parameters.

With regard to FIG. 4, it should be pointed out that the arrows indicating the direction of the water jets 8, 9 extend from the bottoms of spray girders 17, 18, as shown in FIG. 3*b*, although in FIG. 4, they are shown as if they extend from a side of the respective girders 17, 18 remote from the slab surfaces.

In accordance with the invention, the descaling station or apparatus 14 can be provided in front of the entrance of the rolling mill stands 33.

Though the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A method of descaling surfaces having oscillation marks of cast billets produced by a continuous casting process and reduced in a hot strip train including an equalizing furnace and a plurality of rolling mill stands, with the cast billets being delivered from a continuous casting machine through a billet guide, the method comprising the steps of:

subjecting surfaces of a cast billet, in a limited region between an end of the billet guide and an entrance of one of the equalizing furnace and a first rolling mill stand, by at least a double deflection of the cast billet from a horizontal transporting path of the cast billet, to stretching in a region of each deflection; and subjecting the surfaces of the cast billet to an intensive flushing with hard water jets in the deflection regions of the case billet, wherein an amount of each deflection of the cast billet is determined in accordance with a maximum allowable deformation of the cast billet and a maximum allowable surface tension of the cast billet, wherein an amount of each deflection is determined in accordance with a temperature of the cast billet under a condition of a permanent temperature control, wherein the method further includes the step of constantly measuring a variable deflection force in accordance with a structural condition of the cast billet corresponding to cooling which takes place together with descaling, and thereafter, constantly adjusting the water amount with maintaining a product of the water amount and water pressure substantially constant.

* * * * *